US011635240B2

(12) United States Patent
Ranjan et al.

(10) Patent No.: US 11,635,240 B2
(45) Date of Patent: Apr. 25, 2023

(54) SEPARATOR

(71) Applicant: Carrier Corporation, Palm Beach Gardens, FL (US)

(72) Inventors: Rajiv Ranjan, South Windsor, CT (US); Parmesh Verma, South Windsor, CT (US); Haralambos Cordatos, Colchester, CT (US); Biswajit Mitra, Huntersville, NC (US); Subhrajit Chakraborty, Charlotte, NC (US); Ying She, East Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/972,830

(22) PCT Filed: May 8, 2020

(86) PCT No.: PCT/US2020/032083

§ 371 (c)(1),
(2) Date: Dec. 7, 2020

(87) PCT Pub. No.: WO2020/231804

PCT Pub. Date: Nov. 19, 2020

(65) Prior Publication Data

US 2022/0057125 A1 Feb. 24, 2022

Related U.S. Application Data

(60) Provisional application No. 62/848,233, filed on May 15, 2019.

(51) Int. Cl.

| | |
|---|---|
| ***F25B 43/04*** | (2006.01) |
| ***F25B 30/02*** | (2006.01) |
| ***F25B 43/00*** | (2006.01) |

(52) U.S. Cl.
CPC ..... *F25B 43/043* (2013.01); *F25B 30/02* (2013.01); *F25B 43/003* (2013.01); *F25B 2400/23* (2013.01)

(58) Field of Classification Search
CPC ..... F25B 43/043; F25B 30/02; F25B 43/003; F25B 2400/23; B01D 19/0031
See application file for complete search history.

(56) References Cited

U.S. PATENT DOCUMENTS

| | | | |
|---|---|---|---|
| 4,659,343 | A | 4/1987 | Kelly |
| 4,984,431 | A | 1/1991 | Mount et al. |

(Continued)

FOREIGN PATENT DOCUMENTS

| | | | |
|---|---|---|---|
| CN | 203657302 | U | 6/2014 |
| CN | 108168159 | A | 6/2018 |

(Continued)

OTHER PUBLICATIONS

International Preliminary Report on Patentability; International Application No. PCT/US2020/032083; International Filing Date: May 8, 2020; Date of Issuance: Nov. 16, 2021; 10 pages.

(Continued)

*Primary Examiner* — Elizabeth J Martin
(74) *Attorney, Agent, or Firm* — Cantor Colburn LLP

(57) ABSTRACT

A separator for removing contamination from a fluid of a heat pump includes a housing having a hollow interior, a header plate arranged within the hollow interior and having at least one mounting hole, and a separation module mounted within the hollow interior. The separation module includes a connector for forming an interface with the at least one mounting hole. A sealant is located at the interface between the connector and the mounting hole.

18 Claims, 3 Drawing Sheets

(56) References Cited

U.S. PATENT DOCUMENTS

| | | | | |
|---|---|---|---|---|
| 5,236,474 | A | 8/1993 | Schofield et al. | |
| 6,349,562 | B1 | 2/2002 | Kaspar et al. | |
| 6,767,384 | B1 | 7/2004 | Vu et al. | |
| 7,459,084 | B2 | 12/2008 | Baig et al. | |
| 9,987,568 | B2 | 6/2018 | Stark et al. | |
| 10,086,326 | B2 | 10/2018 | Su et al. | |
| 10,247,457 | B2 | 4/2019 | Gu et al. | |
| 2005/0178147 | A1 | 8/2005 | Kaspar et al. | |
| 2010/0030006 | A1 | 2/2010 | Schucker | |
| 2016/0175740 | A1* | 6/2016 | Stark | F25B 43/04 96/6 |
| 2017/0016657 | A1* | 1/2017 | Hosokawa | F25B 43/003 |
| 2017/0176069 | A1 | 6/2017 | Spies et al. | |
| 2018/0045439 | A1* | 2/2018 | Nagy | F25B 47/006 |
| 2018/0066880 | A1* | 3/2018 | Ranjan | B01D 19/0031 |

FOREIGN PATENT DOCUMENTS

| | | | |
|---|---|---|---|
| EP | 0669506 | B2 | 11/2003 |
| EP | 3118545 | A1 | 1/2017 |

OTHER PUBLICATIONS

International Search Report of the International Searching Authority; International Application No. PCT/US2020/032083; International Filing Date: May 8, 2020; dated Sep. 18, 2020; 7 pages.
Written Opinion of the International Searching Authority; International Application No. PCT/US2020/032083; International Filing Date: May 8, 2020; dated Sep. 18, 2020; 11 pages.
Chinese Office Action for Chinese Application No. 202080003456.7; Office Action dated Feb. 11, 2023; 7 pages.

* cited by examiner

SEPARATOR

CROSS REFERENCE TO RELATED APPLICATIONS

This application is a National Stage Application of PCT/US2020/032083 filed May 8, 2020, which claims priority to U.S. Provisional Application 62/848,233 filed May 15, 2019, both which are incorporated by reference in their entirety herein.

BACKGROUND

Embodiments of the present disclosure relate generally to chiller systems used in air conditioning systems, and more particularly to a purge system for removing contaminants from a refrigeration system.

Chiller systems such as those utilizing centrifugal compressors may include sections that operate below atmospheric pressure. As a result, leaks in the chiller system may draw air into the system, contaminating the refrigerant. This contamination degrades the performance of the chiller system. To address this problem, existing low pressure chillers include a purge unit to remove contamination. Existing purge units typically use a vapor compression cycle to separate contaminant gas from the refrigerant. Existing purge units are complicated and lose refrigerant in the process of removing contamination.

BRIEF DESCRIPTION

According to an embodiment, a separator for removing contamination from a fluid of a heat pump includes a housing having a hollow interior, a header plate arranged within the hollow interior and having at least one mounting hole, and a separation module mounted within the hollow interior. The separation module includes a connector for forming an interface with the at least one mounting hole. A sealant is located at the interface between the connector and the mounting hole.

In addition to one or more of the features described above, or as an alternative, in further embodiments the connector is formed from a non-permeable material.

In addition to one or more of the features described above, or as an alternative, in further embodiments the connector is a coating formed about a portion of a body of the separation module.

In addition to one or more of the features described above, or as an alternative, in further embodiments the connector is a separate component mounted to a body of the separation module.

In addition to one or more of the features described above, or as an alternative, in further embodiments the connector is a portion of a body of the separation module.

In addition to one or more of the features described above, or as an alternative, in further embodiments the sealant is an epoxy material.

In addition to one or more of the features described above, or as an alternative, in further embodiments the connector and the sealant cooperate to isolate the separation module from vibration of the header plate.

In addition to one or more of the features described above, or as an alternative, in further embodiments the separation module includes a degassing tube having at least one membrane including a porous surface through which gas, but not refrigerant passes.

In addition to one or more of the features described above, or as an alternative, in further embodiments the at least one membrane is configured such that gas passes radially inwardly into an interior of the at least one degassing tube.

In addition to one or more of the features described above, or as an alternative, in further embodiments a first end of the degassing tube is sealed and a second opposite end of the degassing tube is open.

In addition to one or more of the features described above, or as an alternative, in further embodiments the sealed first end is receivable within the at least one mounting hole of the first header.

In addition to one or more of the features described above, or as an alternative, in further embodiments comprising a second header plate arranged within the hollow interior, the second header plate having at least one second mounting hole, wherein the second, open end of the degassing tube is mounted to a face of the second header plate such that an interior of the degassing tube and the second mounting hole are arranged in fluid communication.

According to another embodiment, a heat pump includes a vapor compression loop and a purge system in communication with the vapor compression loop. The purge system including at least one separator having a housing and at least one separation module for separating contaminants from a refrigerant purge gas provided from the vapor compression loop to the separator when a driving force is applied to the at least one separation module. The at least one separation module is mounted within the housing and includes a connector formed from a non-permeable material arranged at an interface with an adjacent component.

In addition to one or more of the features described above, or as an alternative, in further embodiments the at least one separator further comprises a sealant arranged at the interface between the connector and the adjacent component.

In addition to one or more of the features described above, or as an alternative, in further embodiments the sealant is an epoxy sealant.

In addition to one or more of the features described above, or as an alternative, in further embodiments the connector and the sealant cooperate to isolate the separation module from vibration of the header plate In addition to one or more of the features described above, or as an alternative, in further embodiments the adjacent component includes a header plate having at least one mounting openings formed therein, the at least one mounting opening being associated with the at least one separation module.

In addition to one or more of the features described above, or as an alternative, in further embodiments the connector is a coating formed about a portion of a body of the separation module.

In addition to one or more of the features described above, or as an alternative, in further embodiments the connector is a separate component mounted to a body of the separation module.

In addition to one or more of the features described above, or as an alternative, in further embodiments the connector is a portion of a body of the separation module.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
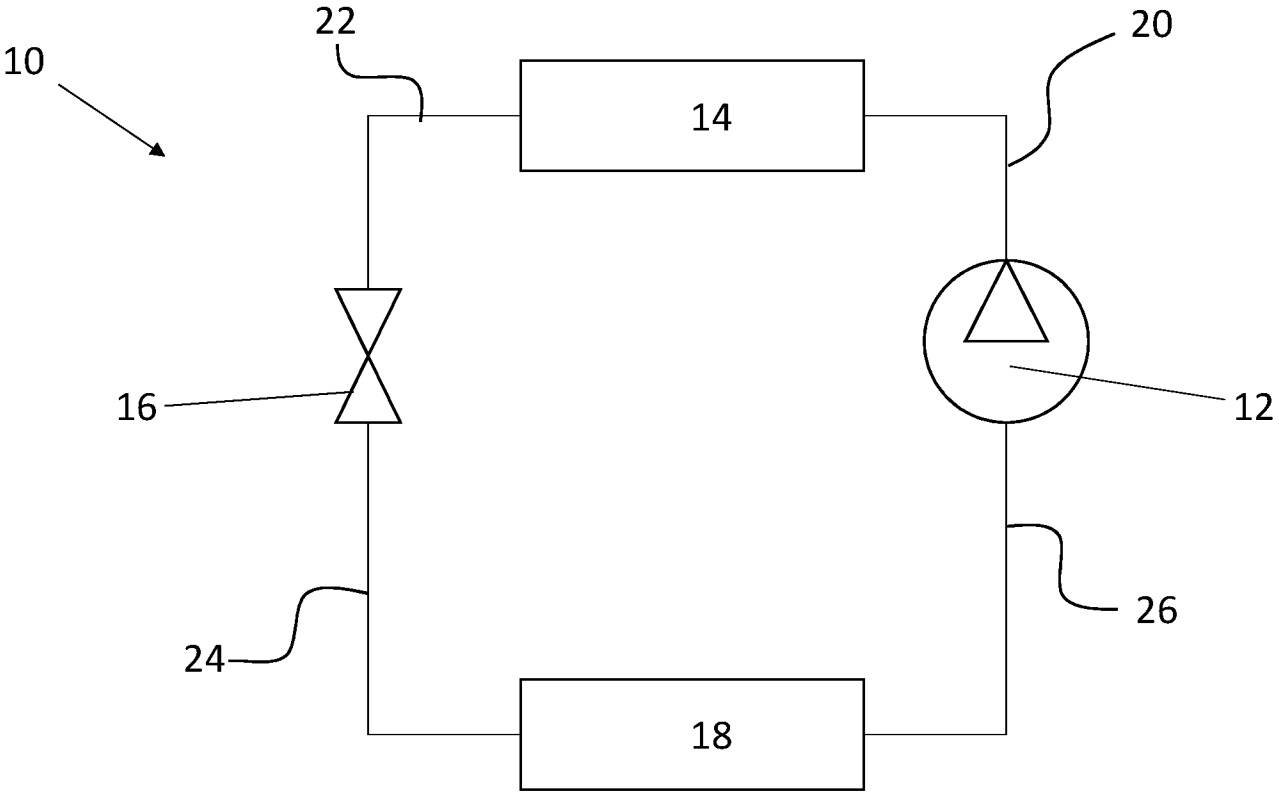
FIG. 1 is a schematic diagram of a heat pump of a refrigerant system.

Referring now to FIG. 1, an example of a heat pump 10 is illustrated. As used herein, the term heat pump is intended to include any system capable of heating and/or cooling, such as a vapor compression system, a sorption system, a geothermal system, a waste heat recovery system, a heat based cooling system, and a heating system. As shown, the heat pump 10 includes a compressor 12, a condenser 14, an expansion valve 16, and an evaporator 18 arranged to form a fluid loop. The compressor 12 pressurizes heat transfer fluid in its gaseous state, which both heats the fluid and provides pressure to circulate it through the system. In some embodiments, the heat transfer fluid, or refrigerant, includes an organic compound. For example, in some embodiments, the refrigerant comprises at least one of a hydrocarbon, substituted hydrocarbon, a halogen-substituted hydrocarbon, a fluoro-substituted hydrocarbon, or a chloro-fluoro-substituted hydrocarbon.

The hot pressurized gaseous heat transfer fluid exiting from the compressor 12 flows through a conduit 20 to a heat rejection heat exchanger such as condenser 14. The condenser is operable to transfer heat from the heat transfer fluid to the surrounding environment, resulting in condensation of the hot gaseous heat transfer fluid to a pressurized moderate temperature liquid. The liquid heat transfer fluid exiting from the condenser 14 flows through conduit 22 to expansion valve 16, where the pressure is reduced. The reduced pressure liquid heat transfer fluid exiting the expansion valve 16 flows through conduit 24 to a heat absorption heat exchanger such as evaporator 18. The evaporator 18 functions to absorb heat from the surrounding environment and boil the heat transfer fluid. Gaseous heat transfer fluid exiting the evaporator 18 flows through conduit 26 to the compressor 12, so that the cycle may be repeated.

The heat pump 10 has the effect of transferring heat from the environment surrounding the evaporator 18 to the environment surrounding the condenser 14. The thermodynamic properties of the heat transfer fluid must allow it to reach a high enough temperature when compressed so that it is greater than the environment surrounding the condenser 14, allowing heat to be transferred to the surrounding environment. The thermodynamic properties of the heat transfer fluid must also have a boiling point at its post-expansion pressure that allows the temperature surrounding the evaporator 18 to provide heat to vaporize the liquid heat transfer fluid.

Various types of refrigeration systems may be classified as a heat pump 10 as illustrated and described herein. One such refrigeration system is a chiller system. Portions of a refrigeration system, such as the cooler of a chiller system for example, may operate at a low pressure (e.g., less than atmosphere) which can cause contamination (e.g., ambient air) to be drawn into fluid loop of the heat pump 10. The contamination degrades performance of the refrigeration system. To improve operation, the heat pump 10 may additionally include a purge system 30 for removing contamination from the heat transfer fluid of the heat pump 10.

Figure 2:
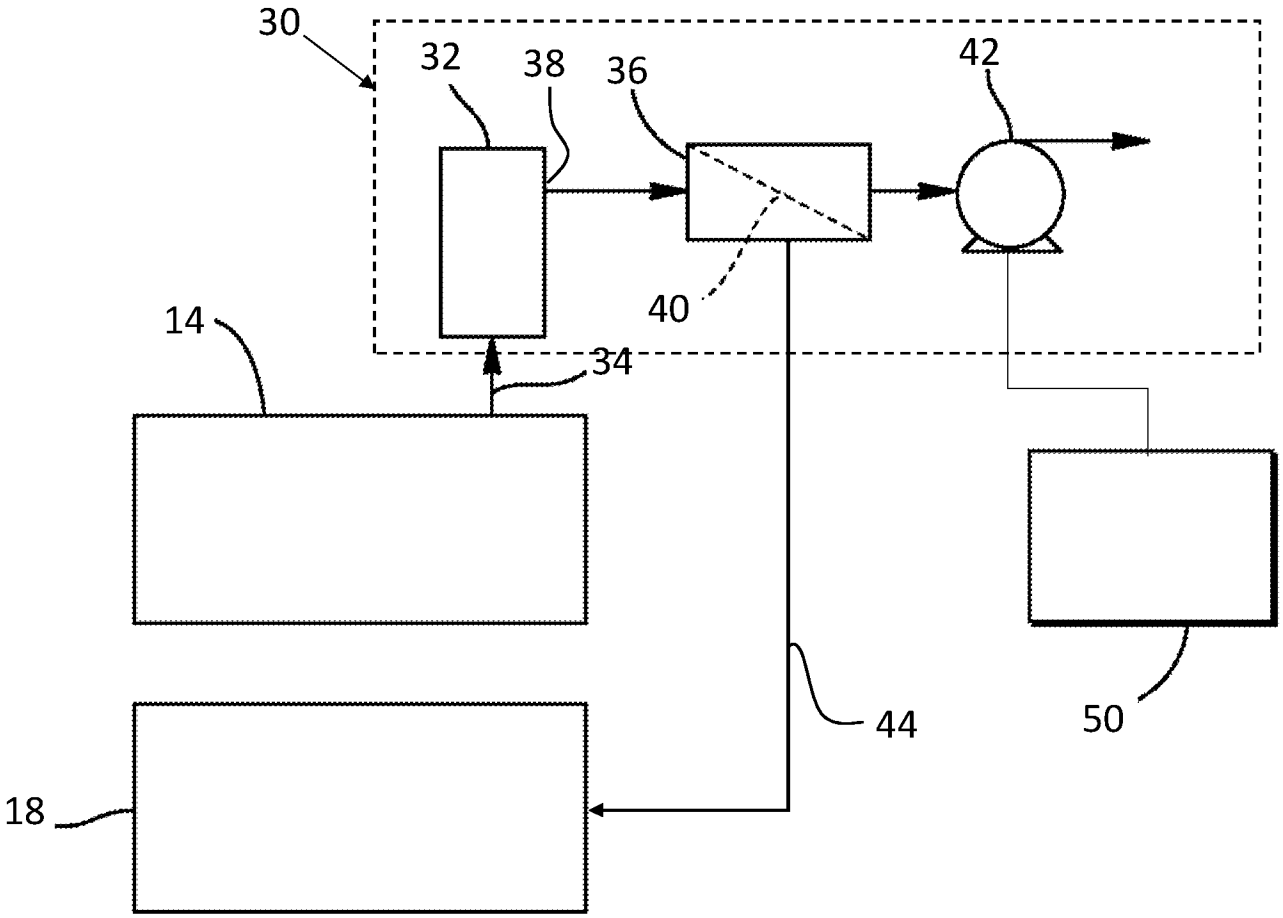
FIG. 2 is a schematic diagram of a purge system according to an embodiment.

With reference now to FIG. 2, an example of a purge system 30 is illustrated in more detail. As shown, the purge system 30 includes a purge collector 32 connected to the condenser 14 of a heat pump 10 via a purge connection 34. The purge collector 32 receives purge gas including refrigerant gas and contaminants, such as nitrogen and oxygen for example, from the purge connection 34. The purge system 30 additionally includes at least one separator 36 arranged downstream from and in fluid communication with an outlet 38 of the purge collector 32. In the illustrated, non-limiting embodiment, the separator 36 includes at least one separating component 40, such as a membrane for example, for separating contaminants from the refrigerant gas. Although a single separator 36 is illustrated, it should be understood that embodiments including a plurality of separators 36, arranged in series or parallel, are also contemplated herein.

In embodiments where the separation component 40 includes a membrane, the membrane may include a porous inorganic material. Examples of porous inorganic materials can include ceramics such as metal oxides or metal silicates, more specifically aluminosilicates, (e.g., Chabazite Framework (CHA) zeolite, Linde type A (LTA) zeolite, porous carbon, porous glass, clays (e.g., Montmorillonite, Halloysite). Porous inorganic materials can also include porous metals such as platinum and nickel. Hybrid inorganic-organic materials such as a metal organic frameworks (MOF) can also be used. Other materials can be present in the membrane such as a carrier in which a microporous material can be dispersed, which can be included for structural or process considerations.

Metal organic framework materials are well-known in the art, and comprise metal ions or clusters of metal ions coordinated to organic ligands to form one-, two- or three-dimensional structures. A metal-organic framework can be characterized as a coordination network with organic ligands containing voids. The coordination network can be characterized as a coordination compound extending, through repeating coordination entities, in one dimension, but with cross-links between two or more individual chains, loops, or spiro-links, or a coordination compound extending through repeating coordination entities in two or three dimensions. Coordination compounds can include coordination polymers with repeating coordination entities extending in one, two, or three dimensions. Examples of organic ligands include but are not limited to bidentate carboxylates (e.g., oxalic acid, succinic acid, phthalic acid isomers, etc.), tridentate carboxylates (e.g., citric acid, trimesic acid), azoles (e.g., 1,2,3-triazole), as well as other known organic ligands. A wide variety of metals can be included in a metal organic framework. Examples of specific metal organic framework materials include but are not limited to zeolitic imidazole framework (ZIF), HKUST-1.

In some embodiments, pore sizes of the material of the membrane can be characterized by a pore size distribution with an average pore size from 25 Å to 10.0 Å, and a pore size distribution of at least 0.1 Å. In some embodiments, the average pore size for the porous material can be in a range with a lower end of 2.5 Å to 4.0 Å and an upper end of 2.6 Å to 10.0 Å. A. In some embodiments, the average pore size can be in a range having a lower end of 2.5 Å, 3.0 Å, 3.5 Å, and an upper end of 3.5 Å, 5.0 Å, or 6.0 Å. These range endpoints can be independently combined to form a number of different ranges, and all ranges for each possible combination of range endpoints are hereby disclosed. Porosity of the material can be in a range having a lower end of 5%, 10%, or 15%, and an upper end of 85%, 90%, or 95% (percentages by volume). These range endpoints can be independently combined to form a number of different ranges, and all ranges for each possible combination of range endpoints are hereby disclosed.

The above microporous materials can be synthesized by hydrothermal or solvothermal techniques (e.g., sol-gel) where crystals are slowly grown from a solution. Templating for the microstructure can be provided by a secondary building unit (SBU) and the organic ligands. Alternate synthesis techniques are also available, such as physical vapor deposition or chemical vapor deposition, in which metal oxide precursor layers are deposited, either as a primary microporous material, or as a precursor to an MOF structure formed by exposure of the precursor layers to sublimed ligand molecules to impart a phase transformation to an MOF crystal lattice.

In some embodiments, the above-described membrane materials can provide a technical effect of promoting separation of contaminants (e.g., nitrogen, oxygen and/or water molecules) from refrigerant gas, which is condensable. Other air-permeable materials, such as porous or non-porous polymers can be subject to solvent interaction with the matrix material, which can interfere with effective separation. In some embodiments, the capabilities of the materials described herein can provide a technical effect of promoting the implementation of various example embodiments of refrigeration systems with purge, as described in more detail with reference to the example embodiments below.

The membrane material can be self-supporting or it can be supported, for example, as a layer on a porous support or integrated with a matrix support material. In some embodiments, thickness of a support for a supported membrane can range from 50 nm to 1000 nm, more specifically from 100 nm to 750 nm, and even more specifically from 250 nm to 500 nm. In the case of tubular membranes, fiber diameters can range from 100 nm to 2000 nm, and fiber lengths can range from 0.2 m to 2 m.

In some embodiments, the microporous material can be deposited on a support as particles in a powder or dispersed in a liquid carrier using various techniques such as spray coating, dip coating, solution casting, etc. The dispersion can contain various additives, such as dispersing aids, rheology modifiers, etc. Polymeric additives can be used; however, a polymer binder is not needed, although a polymer binder can be included and in some embodiments is included such as with a mixed matrix membrane comprising a microporous inorganic material (e.g., microporous ceramic particles) in an organic (e.g., organic polymer) matrix. However, a polymer binder present in an amount sufficient to form a contiguous polymer phase can provide passageways in the membrane for larger molecules to bypass the molecular sieve particles. Accordingly, in some embodiments a polymer binder is excluded. In other embodiments, a polymer binder can be present in an amount below that needed to form a contiguous polymer phase, such as embodiments in which the membrane is in series with other membranes that may be more restrictive. In some embodiments, particles of the microporous material (e.g., particles with sizes of 0.01 μm to 10 mm, or in some embodiments from 0.5 μm to 10 μm) can be applied as a powder or dispersed in a liquid carrier (e.g., an organic solvent or aqueous liquid carrier) and coated onto the support followed by removal of the liquid. In some embodiments, the application of solid particles of microporous material from a liquid composition to the support surface can be assisted by application of a pressure differential across the support. For example a vacuum can be applied from the opposite side of the support as the liquid composition comprising the solid microporous particles to assist in application of the solid particles to the surface of the support. A coated layer of microporous material can be dried to remove residual solvent and optionally heated to fuse the microporous particles together into a contiguous layer. Various membrane structure configurations can be utilized, including but not limited to flat or planar configurations, tubular configurations, or spiral configurations. In some embodiments, the membrane can include a protective polymer coating or can utilize backflow or heating to regenerate the membrane.

In some embodiments, the microporous material can be configured as nanoplatelets, such as zeolite nanosheets for example. Zeolite nanosheet particles can have thicknesses ranging from 2 to 50 nm, more specifically 2 to 20 nm, and even more specifically from 2 nm to 10 nm. Zeolite such as zeolite nanosheets can be formed from any of various zeolite structures, including but not limited to framework type MFI, MWW, FER LTA, FAU, and mixtures of the preceding with each other or with other zeolite structures. In a more specific group of exemplary embodiments, the zeolite such as zeolite nanosheets can comprise zeolite structures selected from MFI, MWW, FER, LTA framework type. Zeolite nanosheets can be prepared using known techniques such as exfoliation of zeolite crystal structure precursors. For example, MFI and MWW zeolite nanosheets can be prepared by sonicating the layered precursors (multilamellar silicalite-1 and ITQ-1, respectively) in solvent. Prior to sonication, the zeolite layers can optionally be swollen, for example with a combination of base and surfactant, and/or melt-blending with polystyrene. The zeolite layered precursors are typically prepared using conventional techniques for preparation of microporous materials such as sol-gel methods.

With continued reference to FIG. 2, a prime mover 42, such as a vacuum pump for example, may be selectively coupled to the separator 36. The prime mover 42 may provide a driving force to pass contaminant gas molecules through the separation component 40, such that the contaminant molecules exit from a second side of the membrane and through an outlet of the purge system 30. In an embodiment, the prime mover 42 can be positioned within the fluid loop. For example, a refrigerant pump or compressor may be used as the prime mover. Refrigerant gas tends to remain on the first side of the separation component 40 and may be returned to the heat pump 10, such as to the evaporator 18 for example, through a connection or conduit illustrated at 44.

A controller 50 is operably coupled to the prime mover 42 of the purge system 30. In an embodiment, the controller 50 receives system data (e.g., pressure, temperature, mass flow rates) and utilizes electronic control components, such as a microprocessor for example, to control one or more components of the purge system 30, such as various pumps, valves, and switches for example, in response to the system data. The purge system 30 illustrated and described herein is intended as an example only, and other configurations are also within the scope of the disclosure. Other examples of purge systems contemplated herein are set forth in more detail in U.S. patent application Ser. No. 15/808,837 filed on Nov. 9, 2017, the entire contents of which is incorporated herein by reference.

When the heat pump 10 is operational, the refrigerant may be passively decontaminated. The pressure from the condenser may create a pressure differential suitable to achieve the required driving force across the separation component 40. As a result, contamination passes through the membrane from a first side to a second side. When the heat pump 10 is non-operational, active decontamination of the separation component 40 is initiated. During active decontamination, the prime mover 42 is used to provide the necessary pressure differential across the separation component 40 for decontamination.

Figure 3:
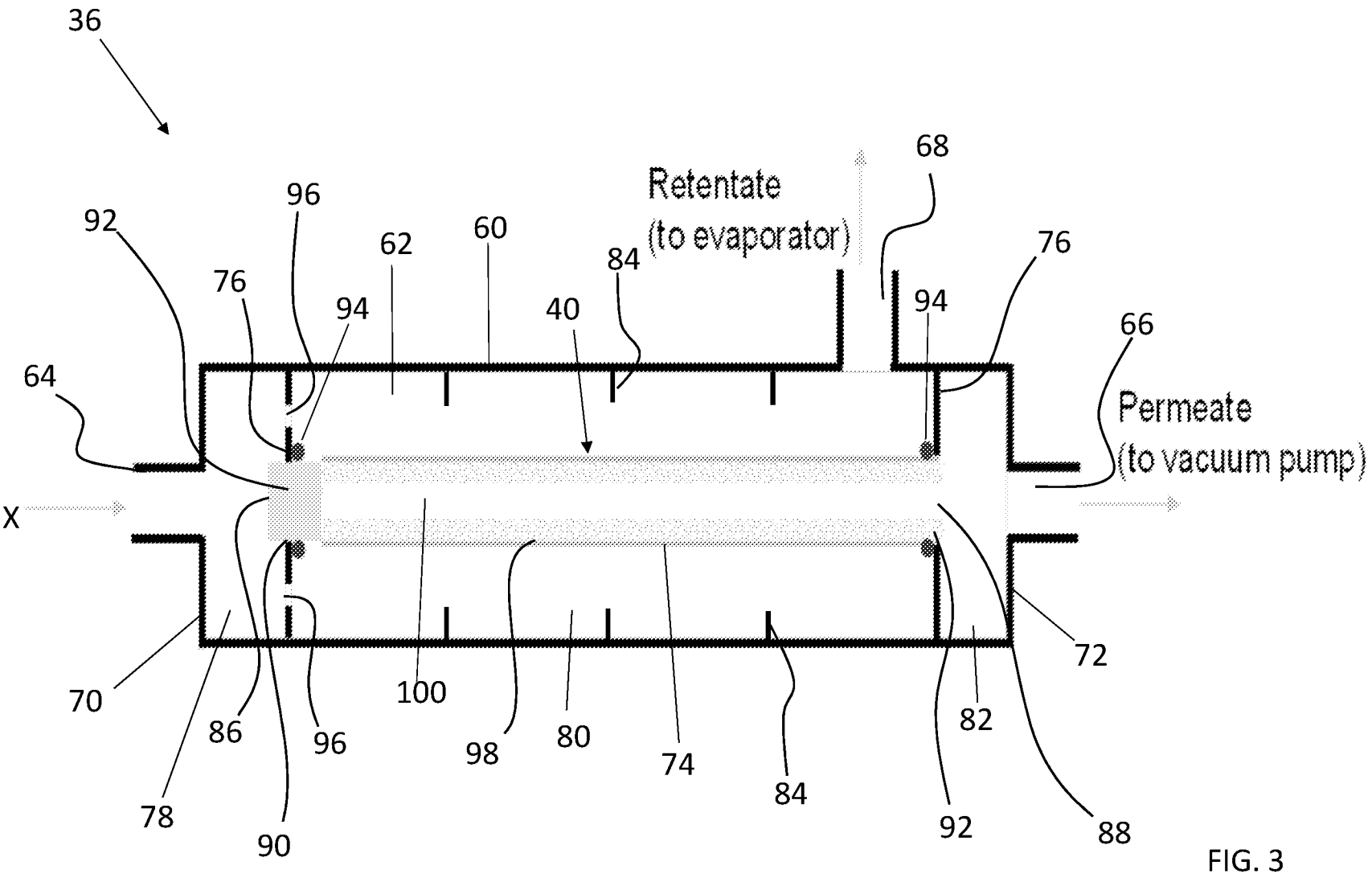
FIG. 3 is a schematic cross-sectional view of a separator of a purge system according to another embodiment.

With reference now to FIG. 3, a configuration of the separator 36 is illustrated in more detail. In the illustrated, non-limiting embodiment, the separator 36 includes a housing 60 having a generally hollow interior 62. Although the housing 60 is shown as being generally cylindrical in shape, it should be understood that a housing 60 having any shape is within the scope of the disclosure. In addition, the housing 60 includes a fluid inlet 64, a first fluid outlet 66 and a second fluid outlet 68. In the illustrated embodiments, the fluid inlet 64 is arranged adjacent a first end 70 of the housing 60, the first fluid outlet 66 is arranged adjacent a second, opposite end 72 of the housing 60, and the second fluid outlet 68 is arranged generally centrally along an axis X defined by the separator 36. However, other configurations of the separator housing 60 are also contemplated herein.

At least one separation component 40 is mounted within the hollow interior 62 of the housing 60. As shown in FIG. 3, in an embodiment, the at least one separation component 40 includes a plurality of degassing tubes positioned longitudinally within the hollow interior 62 of the housing 60. In an embodiment, each of the degassing tubes includes a body 74 formed from a ceramic zeolite material.

The separator 36 additionally includes at least one header plate, such as a first header plate 76 located near the fluid inlet 64 and a second header plate 76 positioned near the first and second outlets 66, 68 within the hollow interior 62 of the housing 60. In the illustrated, non-limiting embodiment, an outer diameter of each header plate 76 is complementary to an inner diameter of the housing 60. As a result, the header plates 76 act as partitions or dividers to separate the hollow interior 62 of the housing 60 into a plurality of zones, such as a first zone 78, a second zone 80, and a third zone 82 for example. The first zone 78 is in fluid communication with the fluid inlet 64, the second zone 80 is in fluid communication with the second fluid outlet 68, and the third zone 82 is in fluid communication with the first fluid outlet 66.

It should be understood that embodiments including a single header plate 76, or alternatively, more than two header plates 76 spaced over the length of the housing 60 are also contemplated herein. Alternatively, or in addition, one or more other vibration and structural supports, such as baffles 84 for example, may be spaced longitudinally within the hollow interior 62 of the housing 60 to support the at least one separation mechanism 40 and/or create turbulence within the fluid flow through the hollow interior 62. In such embodiments, the size and contour of the baffles 84, may, but need not be complementary to the hollow interior 62 of the housing 60.

The one or more degassing tubes 40 are supported within the hollow interior 62 by at least the first and second header plates 76. A portion of each separation component 40, such as a first end 86 and second end 88, respectively, may be mounted to the header plates 76. In the illustrated, non-limiting embodiment, the first header plate 76 includes one or more mounting holes 90 for receiving a portion of a corresponding degassing tube 40 therein. Similarly, the second ends 88 of the degassing tubes 40 may be mounted to a face of the second header plate 76 within the second zone 80, such that each degassing tube 40 is in fluid communication with a mounting hole 90 formed in the second header plate 76. In such embodiments, the first end 86 of each of the degassing tubes 40 is sealed and the second, opposite end 88 is open.

A connector 92 of the degassing tube 40 forms an interface with each header plate 76 or baffle 84. The connector 92 is formed from a non-permeable or non-porous material, such as ceramic for example. In an embodiment, the connector 92 may be a coating in overlapping arrangement with a portion of the body 74. Alternatively, the connector 92 may be formed as a separate component affixed to the body 74 in alignment with header plate 76 or baffle 84. In yet another embodiment, the connector 92 may be an integral portion of the body 74.

Further, an adhesive or sealant, illustrated at 94, may be supplied at the interface between each header plate 76 and/or baffle 84 and an adjacent connector 92 or non-permeable or non-porous portion of a degassing tube 40. In an embodiment, the sealant is an epoxy material compatible for use with the non-permeable or non-porous portion of the tubes. Use of a sealant 94 in place of existing sealing mechanisms and methods, such as an O-ring or a heat shrinking method for example, provides enhanced sealing properties, thereby reducing the likelihood of a leak within the system. Further, because the sealant 94 primarily operates at an ambient temperature, thermal cycling of the sealant 94 has a minimal impact on the operation of both the sealant and the separator 36. In an embodiment, the sealant 94 and the connector 92 may cooperate to form a vibration isolator operable to dampen vibrations transmitted to the degassing tubes 40 by absorbing energy. Accordingly, vibrations from the heat pump 10, which may be transmitted from the separator housing 60 to the degassing tubes 40 via the header plate 76, are dampened by the sealant 94 and connector 92 mounted at each interface.

In the illustrated, non-limiting embodiment, the plurality of degassing tubes 40 are aligned with each other and are spaced apart from one another to permit a transverse fluid flow between adjacent degassing tubes. In such embodiments, at least the first header plate 76 includes a plurality of inlet openings 96 positioned between adjacent degassing tubes 40.

In the illustrated, non-limiting embodiment, a refrigerant including contaminants is configured to contact an exterior surface of the at least one separation component 40. As a result, the contaminants separated from the refrigerant may transfer radially inwardly into an interior of the at least one separation component 40. For example, in the non-limiting embodiment of FIG. 3, the at least one separation component 40 includes one or more inorganic membranes having a porous surface through which gas, but not refrigerant, can diffuse.

During operation of the system, the contaminated refrigerant output from the purge collector 32 is provided to the first zone 78 of the hollow interior 62 of the housing 60 of the separator 36 via the fluid inlet 64. From the first zone 78, the refrigerant flows through one or more openings 96 formed in the first header plate 76 into the second zone 80. Within the second zone 80, the contaminated refrigerant contacts the exterior surface 98 of the at least one separation component 40, causing the contaminants, such as air for example, to diffuse through the sidewall and into the hollow interior 100 of the separation component 40. From the hollow interior 100 of the separation component 40, the contaminants may be provided to the third zone 82, and ultimately, to the first fluid outlet 66 where the contaminants may be exhausted from the purge system 30. The refrigerant within the second zone 80 is provided to the second fluid outlet 68 for return to the heat pump 10, such as via the conduit 44 for example. By positioning the second fluid outlet 68 at the downstream end of the second zone 80 relative to the direction of flow through the separator 36, the refrigerant output from the separator 36 has a reduced concentration of contaminants therein compared to the refrigerant provided to the fluid inlet 64 of the separator 36.

A purge system 30 that uses a non-permeable or non-porous material and sealant to mount a separation component has reduced thermal cycling and vibration, and therefore increased durability while achieving minimal refrigerant loss, and lower operating and maintenance costs.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A separator for removing contamination from a fluid of a heat pump comprising:

a housing having a hollow interior;

a header plate arranged within the hollow interior, the header plate having at least one mounting hole; and a separation module mounted within the hollow interior, the separation module including:

a degassing tube having at least one membrane including a porous surface through which gas, but not refrigerant passes, the at least one membrane being configured such that gas passes radially inwardly into an interior of the at least one degassing tube;

a connector for forming an interface with the at least one mounting hole; and a sealant located at the interface between the connector and the mounting hole.

2. The separator of claim 1, wherein the connector is formed from a non-permeable material.

3. The separator of claim 1, wherein the connector is a coating formed about a portion of a body of the separation module.

4. The separator of claim 1, wherein the connector is a separate component mounted to a body of the separation module.

5. The separator of claim 1, wherein the connector is a portion of a body of the separation module.

6. The separator of claim 1, wherein the sealant is an epoxy material.

7. The separator of claim 1, wherein the connector and the sealant cooperate to isolate the separation module from vibration of the header plate.

8. A heat pump comprising:

a vapor compression loop;

a purge system in communication with the vapor compression loop, the purge system including at least one separator including:

a housing; and at least one separation module for separating contaminants from a refrigerant purge gas provided from the vapor compression loop to the separator when a driving force is applied to the at least one separation module, the at least one separation module being mounted within the housing and including a connector formed from a non-permeable material arranged at an interface with an adjacent component;

wherein the adjacent component includes a header plate having at least one mounting opening formed therein, the at least one mounting opening being associated with the at least one separation module.

9. The heat pump of claim 8, wherein the at least one separator further comprises a sealant arranged at the interface between the connector and the adjacent component.

10. The heat pump of claim 9, wherein the sealant is an epoxy sealant.

11. The heat pump of claim 9, wherein the connector and the sealant cooperate to isolate the separation module from vibration of the header plate.

12. The heat pump of claim 8, wherein the connector is a coating formed about a portion of a body of the separation module.

13. The separator of claim 12, wherein a first end of the degassing tube is sealed and a second opposite end of the degassing tube is open.

14. The separator of claim 13, wherein the sealed first end is receivable within the at least one mounting hole of the first header.

15. The separator of claim 13, further comprising a second header plate arranged within the hollow interior, the second header plate having at least one second mounting hole, wherein the second, open end of the degassing tube is mounted to a face of the second header plate such that an interior of the degassing tube and the second mounting hole are arranged in fluid communication.

16. The heat pump of claim 8, wherein the connector is a separate component mounted to a body of the separation module.

17. The heat pump of claim 8, wherein the connector is a portion of a body of the separation module.

18. A separator for removing contamination from a fluid of a heat pump comprising:

a housing having a hollow interior;

a header plate arranged within the hollow interior, the header plate having at least one mounting hole; and a separation module mounted within the hollow interior, the separation module including a connector for forming an interface with the at least one mounting hole; and a sealant located at the interface between the connector and the mounting hole, wherein the connector and the sealant in combination form a vibration isolator arranged between the separation module and the header plate.

* * * * *